United States Patent [19]

Kimberlin

[11] Patent Number: 4,886,432

[45] Date of Patent: Dec. 12, 1989

[54] BLADDER PUMP ASSEMBLY

[75] Inventor: Denver K. Kimberlin, Norman, Okla.

[73] Assignee: Engineering Enterprises, Inc., Norman, Okla.

[21] Appl. No.: 210,332

[22] Filed: Jun. 23, 1988

[51] Int. Cl.[4] ..... F04B 43/08

[52] U.S. Cl. ..... 417/478; 91/237; 91/240; 91/250; 92/90

[58] Field of Search ..... 417/390, 395, 378, 379, 417/394, 401, 403, 404, 413, 478; 138/30; 166/105.1, 265, 269; 210/416.1, 525, 776; 92/89, 90, 91, 92

[56] References Cited

U.S. PATENT DOCUMENTS

| | | | |
|---|---|---|---|
| 129,353 | 7/1872 | Lytle | 417/118 |
| 751,323 | 2/1904 | Moran et al. | 417/118 |
| 801,981 | 10/1905 | Gosse | 417/118 |
| 2,171,402 | 9/1938 | Muir | 417/118 |
| 2,626,569 | 1/1953 | Knudson | 417/394 |
| 3,039,309 | 6/1962 | Vesper et al. | 417/394 |
| 3,278,451 | 10/1966 | Childs et al. | 417/394 |
| 3,894,583 | 7/1975 | Morgan | 166/68 |
| 3,991,825 | 11/1976 | Morgan | 166/68 |
| 4,025,237 | 5/1977 | French | 417/131 |
| 4,405,292 | 9/1983 | Bixby, Jr. et al. | 417/403 |
| 4,474,540 | 10/1984 | Bonastia et al. | 417/394 |
| 4,527,633 | 7/1985 | McLaughlin et al. | 177/370 |
| 4,546,830 | 10/1985 | McLaughlin et al. | 166/370 |
| 4,678,040 | 7/1987 | McLaughlin et al. | 166/370 |
| 4,746,423 | 5/1988 | Moyer | 166/265 |
| 4,761,225 | 8/1988 | Breslin | 166/265 |

OTHER PUBLICATIONS

Pulse Pump Pneumatic Pumping System by QED Environmental Systems, Inc.

Teflon Bladder Pump and Controller Manual, Modes Industrial Plastics, the Duriron Company, Inc.

*Primary Examiner*—Carlton R. Croyle

*Assistant Examiner*—Robert N. Blackman

*Attorney, Agent, or Firm*—Laney, Dougherty, Hessin & Beavers

[57] ABSTRACT

A downhole bladder pump for pumping ligher-than-water liquids. The pump includes an outer tube closed at its bottom and top, but having slots adjacent its upper end to admit the liquid to be pumped. Positioned concentrically within the outer tube is a cylindrical bladder chamber. A cylindrical bladder is mounted within the bladder chamber and registers with the internal surface of such chamber. A cyclically-operated pneumatic control system periodically delivers pressurized air to the space between the bladder and the bladder chamber to collapse the bladder and pump liquid which has flowed into the bladder. At other times during the cycle, the control system draws the bladder outwardly against the internal surface of the bladder housing by the application of vacuum. The liquid to be pumped is then forced into the bladder through a check valve subassembly positioned in the lower end of the bladder housing. This liquid is next expressed or discharged through an upper check valve system located in the upper end of the bladder housing.

9 Claims, 3 Drawing Sheets

BLADDER PUMP ASSEMBLY

FIELD OF THE INVENTION

This invention relates to a gas powered bladder pump assembly useful for pumping deleterious low density liquids from a subterranean location without comtamination of the air or other gas used to operate the pump.

BACKGROUND OF THE INVENTION

Brief Description of the Prior Art

The need for a pump capable of pumping supernatant, relatively low density, contaminant liquids from a subterranean environment in which such liquids overlie and float upon the water in a water saturated formation has recently substantially intensified. The greater emphasis on the separation from, and removal of, such liquids from ground waters has resulted in part from an enhanced sensitivity of society to the problem of maintaining fresh water supplies in an uncontaminated condition.

One category of environmental comtaminant being encountered with increasing frequency includes liquids which are insoluble in, and substantially immiscible with, water, whether fresh or saline, and which, in having a density which is different from that of water, either float on the surface of the water, or are located beneath the water by reason of being more dense than water. It is now known, for example, that adjacent to some oil and gas refineries which have operated over a period of many years, the accumulation of hydrocarbons which have leaked from tanks and pipelines in the refinery has, in some instances, constituted a serious source of contamination of aquifers and other subterranean waters. Further, the quantities of such hydrocarbons which stratify on the surface of subterranean waters have sometimes been sufficient to make their recovery an economically attractive proposition.

For the purpose of recovering hydrocarbons, or other lighter-than-water liquids from a subterranean environment where these liquids float on the ground water present, several types of specializied pumps which are well adapted to recover these liquids by pumping, following their separation from the water, have been developed.

In general, the hydrocarbons or other low density liquids are separated from water upon which such liquids float by a density difference and gravity flow technique in which the pump to be utilized is first lowered to a position in which an intake of the pump is located at approximately the location of the interface between the water and the supernatant hydrocarbon. Openings to the pump housing are provided at a level above this interface so that only hydrocarbons will flow through the openings and into the pump for purposes of removal by the pump. After a pumping chamber within the pump has been filled with the liquid which enters in the described fashion, one type of pump in use is pneumatically actuated to express or drive the liquid thus accumulated in the pump upwardly to the surface where it can be recovered at a suitable remote location. The air or other gas used to operate the pump is cyclically charged under pressure, and, alternately, is exhausted to the atmosphere during a different phase of the pump operation.

Patents which disclose pumps of the type described which are pneumatically operated to remove separated hydrocarbons by alternately charging air under pressure to the pump, and then venting air in the pump chamber to the atmosphere as the chamber is filled with hydrocarbon liquid, include U.S. Pat. No. 4,678,040 to McLaughlin et al, U.S. Pat. No. 4,546,830 to McLaughlin et al, U.S. Pat. No. 4,527,633 to McLaughlin et al, U.S. Pat. No. 129,353 to Lytle, U.S. Pat. No. 751,323 to Moran et al, U.S. Pat. No. 801,991 to Gosse, U.S. Pat. No. 2,171,402 to Muir, U.S. Pat. No. 3,894,583 to Morgan, U.S. Pat. No. 3,991,825 to Morgan and U.S. Pat. No. 4,025,237 to French.

The commercially available Pulse Pump of QED Environmental Systems, Inc., is a pneumatically controlled pump useful for the described purpose.

A pump utilizing a Teflon (polytetrafluoroethylene) bladder to intake, and then discharge, a water sample is marketed by the MIP Division of The Durison Company, Inc. of Dayton, Ohio. In this pump, the liquid to be pumped flows through a check valve into a space between the exterior of the bladder and a rigid pump housing. This causes the bladder to collapse. Air is then forced into the bladder under pressure to expel the accumulated liquid from the space between the bladder and the rigid housing.

BRIEF DESCRIPTION OF THE PRESENT INVENTION

The present invention is a bladder pump useful for pumping hydrocarbons (or other lighter-than-water liquids) from a subterranean location so as to effect a separation of the hydrocarbons from ground water. The bladder pump functions effectively to pump hydrocarbons or other pollutant low density liquids without contaimination of the air, or other pumping gas used to operate the pump and recirculated to a location above the ground during the operation of the pump.

Broadly described, the bladder pump of the invention comprises an external cylindrical skimmer tube which is closed at its opposite ends by suitable closure plates or plugs, and which is provided near its upper end with a plurality of slots or perforations which function to admit hydrocarbon to the interior of the skimmer tube. Disposed concentrically within the skimmer tube so as to define an annulus therewith is a cylindrical bladder housing or chamber. The bladder housing extends from the top closure plate of the skimmer tube to a location spaced upwardly from the bottom closure plate thereof.

A flexible cylindrical bladder lines the inner wall of the housing and is secured in this position by an upper and lower check valve assembly inserted in the upper and the lower ends, respectively, of the bladder housing. A tube or pipe is connected to the upper check valve assembly for permitting a hydrocarbon liquid, or other deleterious low density liquid material, to be expelled from the interior of the bladder during operation of the pump. The lower check valve assembly functions to admit hydrocarbon liquid to the interior of the cylindrical bladder from the intake portion of the pumping cycle.

At least one fluid flow tube projects through the upper closure plate and communicates at its lower end with the space between the cylindrical bladder housing and the exterior of the flexible bladder. The fluid flow tube is externally connected to an automatic timing and control means which functions to control the time periods during the pumping cycle when air under pressure is charged to the space between the bladder and its surrounding bladder housing, and when this air is evacuated from this space, and when the space is simply vented to the atmosphere so that the pump is allowed to undergo a filling phase. During this phase, the space defined within the cylindrical bladder fills with hydrocarbon or other relatively light liquid from the subterranean location where the pump is positioned.

An important object of the present invention is to provide an improved pump which can be very effectively employed to separate supernatant hydrocarbon liquids and/or other lighter-than-water liquids floating on top of the water within a saturated water zone in a subterranean location.

Another object of the invention is to provide a pump for pumping environmentally deleterious liquids by the use of a gas employed to operate the pump, and to carry out such pumping in a way such that the pumping gas does not become contaminated with vapors from the liquid which is pumped so as to constitute a potential atmospheric pollution hazard.

Another object of the invention is to provide a bladder pump which uses both a positive force to expel liquids from the pump by constriction or contraction of the bladder, and also a positive force to distend the bladder by vacuum, and thereby return it to its original preconstricted geometric configuration.

A further object of the invention is to provide a bladder pump which is suitable for downhole use in pumping liquids from a subterranean location, and which has few moving parts within the part of the pumping assembly located in the well bore, and which is constructed so that such moving parts do not easily become damaged, torn or worn out over extended periods of usage.

Additional objects and advantages will become apparent when the following detailed description of the invention is read in conjunction with the accompanying drawings which illustrate a preferred embodiment of the invention.

GENERAL DESCRIPTION OF THE DRAWINGS

FIG. 6 is a schematic view of the bladder pump external pneumatic control system which is used to set and control the pressure, exhaust and vacuum phases of the operating cycle of the pump.

DETAILED DESCRIPTION OF A PREFERRED EMBODIMENT OF THE INVENTION

Figure 1:
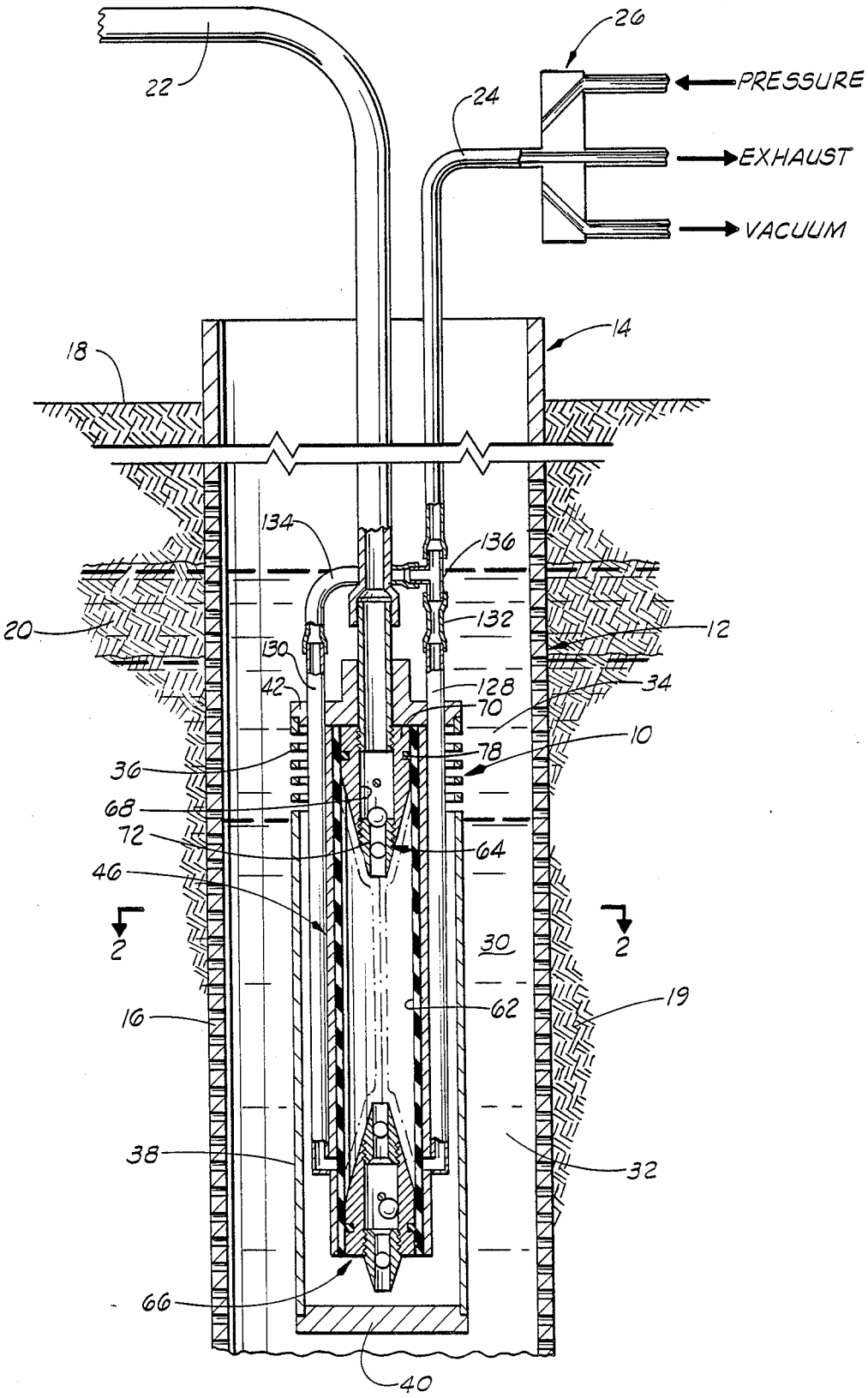
FIG. 1 is a vertical sectional view through the bladder pump of the invention as the pump appears when it is located in a downhole position within a screen at the lower end of a casing preparatory to use of the bladder pump for removing a lighter-than-water contaminant from a subterranean location.

The bladder pump 10 of the invention is illustrated in FIG. 1 as it appears when disposed in an operating situs. The bladder pump 10 is suspended in a well bore 12 lined by casing 14 which carries a perforated well screen 16 at its lower end. The well casing 14 projects upwardly to a location above the surface 18 of the ground as shown in FIG. 1.

The well bore 12 traverses a water saturated formation 19 in the earth, and the purpose of projecting the well bore into the earth at this location is to remove hydrocarbons or other lighter-than-water contaminants which, due to density difference, float on the upper surface of the water in the water saturated formation. Such layer of contaminants is designated generally by reference numeral 20 in FIG. 1 of the drawings.

A discharge pipe 22 connected to and extending upwardly from the pump 10 is provided for discharging hydrocarbon liquid pumped from the hydrocarbon layer in the subterranean formation in the manner hereinafter described.

The bladder pump 10 is also connected by suitable tubing or conduits to a pneumatic external control system. Thus, a pipe or tubing 24 projects upwardly from the pump 10 to the surface and is connected to a pump cycle external control system. The control system is illustrated in detail in FIG. 6, and is hereinafter described. A part of the external control system is pictured diagrammatically in FIG. 1, and there denominated generally by reference numeral 26. The schematic portrayal at 26 in FIG. 1 can actually be equated to a high capacity three-way poppet valve, hereinafter described, which three-way valve is used for delivering a pressure fluid, such as pressurized air, to the pump 10 at one phase of the pumping cycle. This three-way valve is also used for exhausting a pressurized fluid from the pump 10 during another phase of the pumping cycle, and finally, for applying a vacuum to a bladder forming a part of the pump to expand the bladder during another phase of the pumping cycle.

Figure 3:
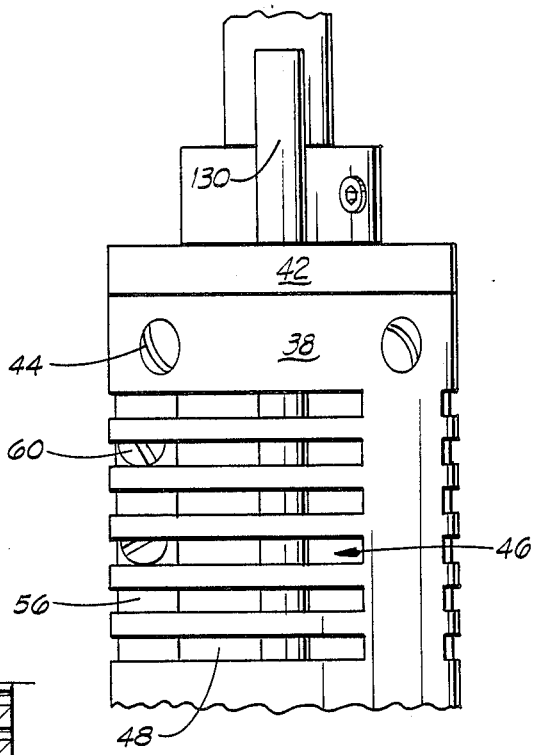
FIG. 3 is a partial side elevation view of the upper portion of the bladder pump of the invention illustrating the manner in which a slotted fluid intake screen of an outer skimmer tube is secured in the pump assembly.

Liquids from the liquid saturated portion of the formation adjacent the perforated well screen 16 flow through the perforations in the screen and into an annulus 30 which surrounds the pump 10 as shown in FIG. 1. Within the annulus 30 the liquids stratify so that the heavier water layer 32 is lower within the annulus, and the hydrocarbon liquid 34 floats on top of the water layer. The pump 10 is suspended by a wire line (not shown), or is positioned by any other suitable means, within the well bore 12 so that a fluid intake slotted upper end portion 36 of an external skimmer tube 38 forming a part of the pump 10 is located just above the interface between the hydrocarbon layer and the water layer, and thus will function to admit only hydrocarbon to the interior of the skimmer tube 38. At its lower end, the skimmer tube 38 is closed by a bottom skimmer tube closure plate 40, and at its upper end it is closed by a top skimmer tube closure plate 42. The skimmer tube 38 is secured to the top skimmer tube plate 42 by a plurality of suitable screws 44 as shown in FIG. 3.

Figure 2:
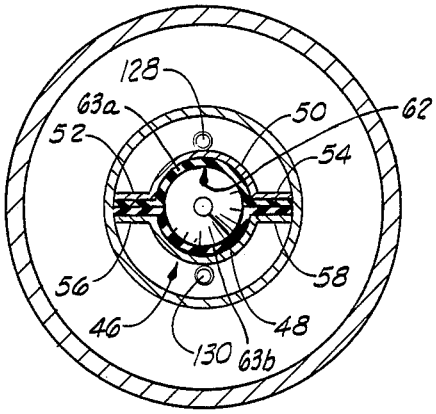
FIG. 2 is a sectional view taken along line 2—2 of FIG. 1.

Positioned concentrically within the skimmer tube 38 is a cylindrical bladder support chamber designated generally by reference numeral 46. The cylindrical bladder support chamber 46 is constructed by joining a pair of semicylindrical chamber halves 48 and 50, with each of the semicylindrical chamber halves having a pair of radially outwardly directed coplanar flanges as shown in FIG. 2. Thus, the semicylindrical chamber half 50 carries radially extending coplanar flanges 52 and 54, and the semicylindrical chamber half 48 carries radially extending flanges 56 and 58. In assembling and constructing the bladder support chamber 46, the flanges are aligned, as shown in FIG. 2, and are secured to each other by means of suitable screws or fastening devices 60 as shown in FIG. 3.

The cylindrical bladder support chamber 46 is internally lined with a flexible, resilient bladder 62 which is preferably constructed of Viton coated, Kevlar fabric. VITON is a fluoroelastomeric co-polymer of vinylidine fluoride and hexafluoropropylene, and KEVLAR is an aromatic polyamide fiber. The bladder 62 is substantially coextensive in length with the cylindrical bladder support chamber 46. The bladder 62 is made of two semicylindrical, flanged parts 63*a* and 63*b* each of which carry a pair of opposed aligned diametric flanges which are trapped or wedged between the flanges 52, 54, 56 and 58 as shown in FIG. 2. The outside diameter of the bladder 62 in a relaxed condition corresponds substantially to the inside diameter of the bladder support chamber.

The bladder 62 is retained in the illustrated position within the cylindrical bladder support chamber 46 by means of a pair of check valve assemblies 64 and 66. The check valve assemblies 64 and 66 are pressed tightly into the upper and lower ends, respectively, of the cylindrical bladder support chamber so as to wedgingly and frictionally engage the upper and lower ends of the bladder 62, and trap the bladder and hold it in a fixed position within the bladder support chamber 46. It is possible, and is indeed preferred, to construct the check valve assemblies 64 and 66 substantially identically so that they can be used interchangeably.

The upper check valve assembly 64 includes a check valve head 68 which includes a generally cylindrical portion 70 of approximately the same outer diameter as the diameter of the flexible bladder 64, and a frustoconical lower portion 72 adjacent the cylindrical upper portion, which lower portion projects inwardly and downwardly within the bladder 62. The check valve head 68 carries an external circumferential or annular groove for the accommodation of an O-ring seal 78.

The check valve head 68 defines a central, axially extending bore 80 which projects from one end to the other of the check valve head, and terminates in an opening at the inner end of the frustoconical portion 72. Adjacent the opening of the bore 80 in the frustoconical end portion of the upper check valve 64, the bore 80 is threaded to permit a check valve seat 82 to be threaded into the bore. The check valve seat 82 is provided with a seat surface 86 and a fluid passageway 88. It is also provided with transverse ports 90 which allow fluid to enter the passageway.

Extending diametrically across the bore 80 through the check valve head 68 is a ball check stop rod 94. The ball check stop rod 94 functions to limit the opening movement of a ball check 96 which is adapted to move off of the seat surface 86 at a time when the upper check valve assembly 64 is in an open status.

The upper end portion of the bore 80 through the upper check valve head 68 ends in an upper opening at the upper end of the check valve head. Adjacent this upper opening, the bore 80 is threaded as shown at 100 to enable it to threadedly engage external threads carried on the lower end of a tubing sub 101 which is pressed into the lower end of the discharge pipe 22 hereinbefore described.

As previously indicated, the lower check valve assembly 66 is constructed quite similarly to the upper check valve assembly 64, and thus includes a lower check valve head 102 which includes a lower, generally cylindrical portion 104 and an upper or internal frustoconical portion 106. An external annular groove 108 is carried on the generally cylindrical portion 104 to permit an O-ring seal 110 to be located in the groove, and to seal against the internal surface of the bladder 62 when the lower check valve assembly 66 is pressed into the lower end of the cylindrical bladder support chamber 46 with the bladder surrounding it.

The lower check valve assembly 66 also has an axially extending bore 111 projecting from the lower to the upper side of the check valve head, and defining, at the upper or inner end thereof, an opening 112 which functions to receive an externally threaded fluid passageway nipple 114. The fluid passageway nipple 114 preferably has transverse openings 116 which communicate with a central passageway 117 therethrough. The passageway 117 is axially aligned and communicates with the bore 111 through the check valve head 102 of the lower check valve assembly 66.

A second check valve head 118 is threaded into the internally threaded lower end portion of the bore 111 of the lower check valve assembly 66, and defines a seating surface 120 at the upper end thereof. The seating surface 120 functions in cooperation with a ball check 122 to check fluid flow out of the cylindrical bladder 62 during one phase of the operation of the pump as hereinafter described. The opening movement of the ball check 122 is limited by a transversely extending ball check stop rod 124.

It will be noted in referring to FIG. 1 of the drawings that the lower or outer check valve head 118 of the lower check valve assembly 66 projects into the space defined between the lower end of the cylindrical bladder support chamber 46 and the bottom skimmer tube closure plate 40 which closes the lower end of the cylindrical skimmer tube 38. From the description thus far, it will now be perceived that liquid from the annulus 30 between the pump 10 and the well screen 16 can pass into the external skimmer tube 38 via the openings through the slotted fluid intake upper end portion 36 of the skimmer tube. From this point of entry, the hydrocarbon liquids gravitate downwardly into the space adjacent the lower end of the cylindrical bladder support chamber 46 where it is closed by the lower check valve assembly 66. From this position, the liquid thus introduced into the external skimmer tube 38 is positioned to pass through the lower check valve assembly 66 into the interior of the cylindrical bladder 62 during an intake phase of the operation of the pump as hereinafter described. It will also be noted that any fluid which is located within the bladder 62 can be discharged from this location through the upper check valve assembly 64 and into the hydrocarbon liquid discharge pipe 22 when the upper check valve 64 is in an open status. This occurs during one phase of the operating cycle of the pump 10, and will be hereinafter described.

For the purpose of permitting the flexible cylindrical bladder 62 to be operated so as to cyclically undergo a pumping movement, a pair of fluid flow tubes 128 and 130 are projected through sealed openings in the top skimmer tube closure plate 42. These tubes extend downwardly through the annulus between the cylindrical bladder support chamber 46 and the external skimmer tube 38 to a location spaced upwardly a short distance from the bottom of the cylindrical bladder support chamber 46. The fluid flow tubes 128 and 130 communicate, at their lower ends, through the cylindrical bladder support chamber 46 with the outer side of the bladder 62. They are thus able to function to deliver an actuating fluid to the space between the bladder 62 and the cylindrical bladder support chamber 46, or, at a different time during the pump operating cycle, to evacuate this space, all in response to a pneumatic external control system 26 hereinafter described.

The pump 10 is connected to the pneumatic external control system 26 through a three-way poppet valve 132 which forms a part of the control system. The shifting of the three-way poppet valve 132 functions to sequentially connect it to various sources of pressure fluid, or vacuum or atmospheric exhaust, at different phases of the pumping cycle as hereinafter described. As shown in FIG. 6, the three-way poppet valve 132 includes a fluid actuated pilot 134 which functions, at certain times during operation of the pump, to cause shifting of this valve.

The control system 26 which includes the high capacity three-way poppet valve 132 is illustrated in FIG. 6 of the drawings. A pressurized gaseous fluid, such as air, used for operating the bladder pump 10 is charged through the control system 26 shown in this Figure. The pneumatic external control system 26 thus receives high pressure air at a typical pressure of about 100 psi via a charging conduit 138. The high pressure air enters the system through a high capacity filter 140 and a high capacity pressure regulator 142. Air discharged from the high capacity pressure regulator 142 is divided and the main volume of the air from the regulator flows through a relatively large diameter conduit 144. A relatively smaller volume of air from the regulator 142 flows through a smaller diameter conduit 146.

It will be perceived that the main volume of air flowing in the conduit 144 is directed to the high capacity three-way poppet valve 132, and is shown, from the status of the latter valve, as being directed through this valve into the pipe 24. The pressurized air is therefore at this time being directed to the pump 10, and, as will be subsequently explained, is functioning to force the collapse of the bladder 62 inwardly toward the position shown in FIG. 5. The described status of the three-way poppet valve 132 occurs at a time when the pilot 134 of this valve is not pressurized.

The relatively small volume of pressurized air from the conduit 146 flows through a low volume filter 148 and a low volume pressure regulator 150. The low volume pressure regulator 150 is, in a preferred method of operation, adjusted to a pressure of about 50 psi as shown on the pressure gauge 151.

After passing through the low volume pressure regulator 150, the air discharged therefrom flows through a conduit 152 to a three-way valve 154, hereinafter referred to as the exhaust cycle valve. In the illustrated status of the exhaust cycle valve 154, air passes through this valve into a conduit 156 by which the air is conducted to the flow control and check valve assembly 158 which controls the flow of air to the pilot 160 of a three-way valve 162 hereinafter referred to as the pressure cycle valve.

At this time, high pressure air of a relatively large volume continues to flow to the pump 10 through the three-way valve 132 for a period of time which is determined by the size of an air volume chamber 164 and the setting of an adjustable flow control 166, both of which form parts of the flow control and check valve assembly 158 associated with the pilot 160 of the three-way pressure cycle valve 162. The described parameters, in conjunction with the pilot acutation pressure which is characteristic of the pilot 160, will determine the time period over which the pressure cycle continues and high pressure air continues to be delivered to the pump 10 via the pipe 24 and the fluid flow tubes 128 and 130.

Figure 5:
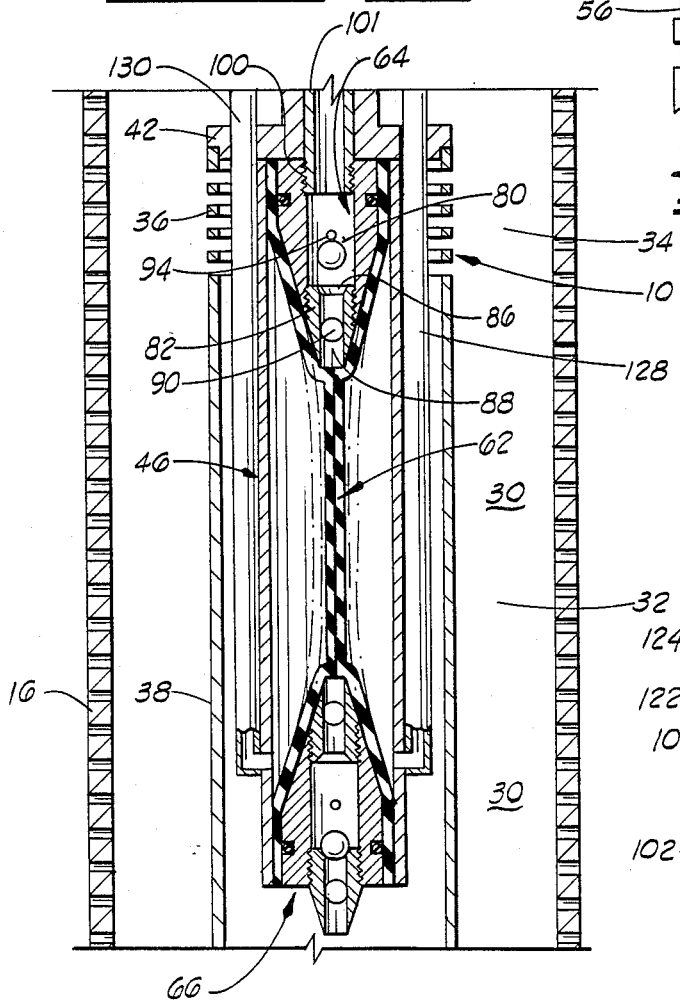
FIG. 5 is a partially sectional, partially diagrammatic view illustrating the pump at the end of a pumping stroke with the bladder collapsed.
Figure 4:
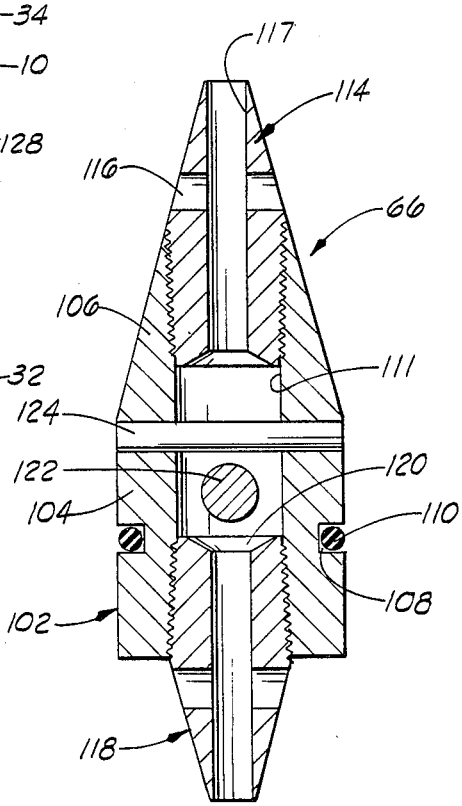
FIG. 4 is an enlarged sectional view of one of the check valve assemblies used in the bladder pump.
Figure 3:
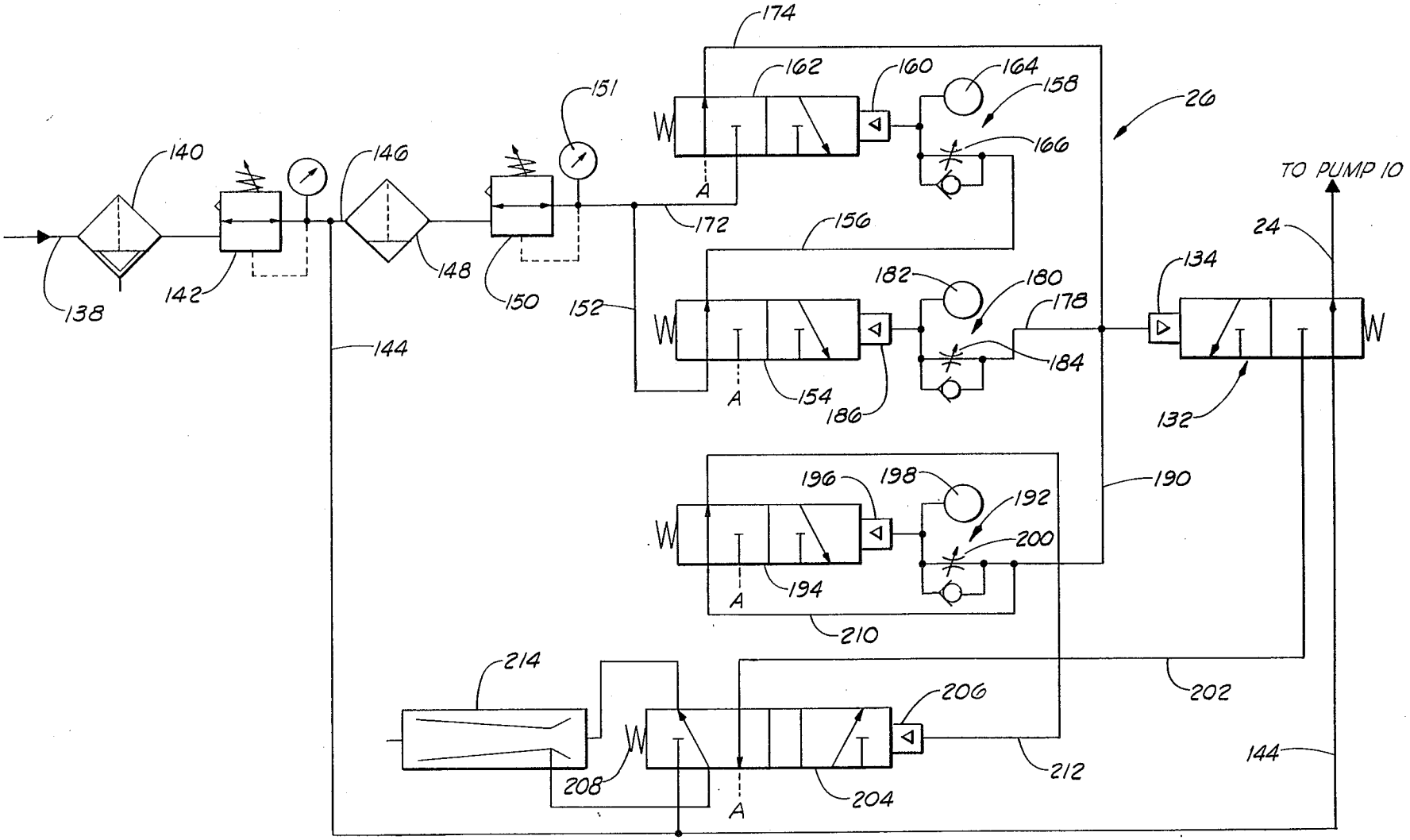

It will be perceived that during this part of the cycle, high pressure air is delivered to the space between the bladder 62 and the cylindrical bladder support chamber 46 so as to force constriction of the cylindrical bladder radially inwardly in the manner illustrated in FIG. 5. This will cause fluid contained within the bladder 62 to be expressed or discharged from that space, and this forces the opening of the upper check valve assembly 64, and the closure of the lower check valve assembly 66. In a preferred method of operating the pump 10 of the invention, the pressure cycle of the pump is set to extend over a period of from zero to thirty seconds by adjustment of the pilot acutation pressure of the pilot 160, the size of the volume chamber 164 and the flow allowed through the adjustable control valve 166.

When an adequate pressure has built up in the volume chamber 164, the result is that the pilot 160 will respond to this pressure and will shift the three-way pressure cycle valve 162. The shifting of the three-way pressure cycle valve 162 causes air under pressure to be directed from a conduit 172 through the valve 162 and into a conduit 174. The pressurized air in the conduit 174 is applied to the pilot 134 of the three-way poppet valve 132. The pressurized air from the conduit 174 also is directed through a branch conduit 178 to a timing control assembly 180 of the three-way exhaust cycle valve 154. The timing control assembly 180 includes a volume chamber 182 and an adjustable flow control valve 184. The timing control assembly 180 functions to control the air pressure which is applied to the pilot 186 of the three-way exhaust cycle valve 154.

Concurrently with the application of pressure through the conduit 178 to the timing control assembly 180, air under pressure is applied through the conduit 190 to a timing control assembly 192 associated with a three-way vacuum cycle valve 194 and its associated pilot 196. The timing control assembly 192 includes a volume chamber 198 and an adjustable flow control valve 200.

The pressure applied to the pilot 134 of the three-way poppet valve 132 at this time shifts this valve so as to connect the pump 10 through the valve 132 to a conduit 202. The conduit 202 is connected to a high capacity four-way valve 204 which is operated by a pilot 206 acting in opposition to a spring 208. At this time, the three-way vacuum cycle valve 194 is shifted so that pressurized air from a conduit 210 passes through the vacuum cycle valve and enters a conduit 212 which acts upon the pilot 206 of the four-way valve 204.

When the pilot 206 responds to pressure from the conduit 212 to shift the valve 204, the result is that relatively high pressure air from the conduit 144 passes through the valve 204 and is discharged through a Venturi ejector 214. Flow of high pressure air through the Venturi ejector 214 causes a vacuum to be generated which acts through the then connecting port through the valve body of the four-way valve 204 to apply a vacuum to the conduit 202. This vacuum is thus applied at this time to the pump 10 by way of the three-way poppet valve 132 which has been shifted as previously described.

The vacuum thus developed is applied to the pump 10 through the fluid flow tubes 128 and 130 so that the air between the bladder 62 and the cylindrical bladder support chamber 46 is evacuated, and the bladder 16 is drawn outwardly against the internal wall of the bladder support chamber. The vacuum developed at the Venturi ejector 214 is applied to the pump 10 for a period of time which is determined by the size of the volume chamber 198 of the three-way vacuum cycle valve 194, as well as the adjusted flow rate through the adjustable flow control valve 200, and the minimum pilot actuation pressure which has been made to characterize the pilot 196 of the three-way exhaust cycle valve 194. These component characteristics should be selected so as to achieve a timing period for the application of vacuum to the pump over a period of from zero to fifteen seconds.

It will be recalled that at the time adequate pressure has been built up to shift the three-way pressure valve 162, thereafter pressure is applied to the pilot of the three-way exhaust cycle valve 154, and also to the pilot 196 of the three-way vacuum cycle valve 194. Thus, both timing periods for the exhaust cycle and the vacuum cycle begin at the same time. The vacuum cycle flow adjustment control valve 200 is set, however, to a time period which is approximately ten seconds, whereas the exhaust cycle flow adjustment control valve 184 is set for a time which is typically substantially greater than ten seconds. Therefore, the vacuum cycle during the operation of the pump will end before the exhaust cycle valve is shifted by its pilot.

When adequate pressure is built up in the volume chamber 198 associated with the three-way vacuum cycle valve 194, this vacuum cycle valve shifts. This causes pressure to be applied to the pilot 206 of the four-way valve 204, causing the four-way valve to exhaust fluid from the pump to the atmosphere, and shifting the four-way valve to remove the Venturi ejector 214 from its connection to the vacuum and pressurized air supply lines. This is the status of the four-way valve 204 as it is illustrated in FIG. 6.

The pump 10 is allowed to exhaust to the atmosphere, A, through the valve 132, conduit 202 and valve 204 for a period of time which is determined by the size of the volume chamber 182, the flow through the adjustable metering or flow valve 184 and the minimum pilot actuation pressure of the pilot 186 associated with the three-way exhaust cycle valve 154. The exhaust cycle should be set to operate over a period of up to about six hours to give adequate time for the bladder 62 to fill. Under normal operations, during the beginning of pumping underground hydrocarbon contaminants, the initial hydrocarbon stratum thickness will be relatively great, and initial hydrocarbon fluid production will occur in high volume and at a relatively rapid rate, and the bladder fill time is then set to zero or a very low time delay. After one or two years of continuous recovery of hydrocarbon contaminants, however, the fluid production will decrease greatly, and there will be a very thin layer of hydrocarbons remaining on the water. The well may then take several hours to accumulate enough fluid in the fill tube to fill the pump cavity. At this time, setting the system for a fill time of as much as six hours may often be desirable.

At the end of the described period, when adequate pressure is built up in the volume chamber 182, the pilot 186 then shifts the three-way exhaust cycle valve 154. The valve 154 shifts from the position illustrated in the drawing to a position such that pressure is relieved from the pilot 160 on the three-way pressure cycle valve 162 through the check valve connected in parallel with the flow control valve 166. This air thus relieved from the pilot 160 can thus be exhausted to the atmosphere through the shifted three-way exhaust cycle valve 154. This pressure release from the pilot 160 on the three-way pressure cycle valve 162 allows this valve to return to the position illustrated in FIG. 6. Pressurized air in the conduit 174 is then vented to the atmosphere and this, in turn, relieves the pressure on the pilots 186, 134 and 196 of the valves 154, 132 and 194, respectively. The shifting of these valves in this fashion by relief of the pressure applied to their pilots brings the control system back to the original starting state, and the process then repeats as long as the air supply pressure is maintained.

OPERATION

In operating the bladder pump 10 of the invention, the pump is connected to the pneumatic external pump cycle control system 26 through the three-way poppet valve 132. As illustrated in FIG. 1, this poppet valve can be schematically portrayed, at different times in the operating cycle, as exhausting air from the pump to the atmosphere, evacuating air by the development of vacuum to draw the air from the space between the flexible bladder 62 and the bladder support chamber 46 and pressurizing the pump by the delivery of air under pressure to the space between the flexible bladder and the bladder support chamber.

After the pump 10 has been positioned in the well bore 12 in the location shown relative to the interface between the lighter hydrocarbon liquid and the underlying water, the first phase in the operation of the pump is a filling phase. Hydrocarbon liquid is allowed to flow through the slots or openings in the slotted fluid intake upper end portion 36 of the external skimmer tube 38. The hydrocarbon liquid then gravitates downwardly in the annulus 30 between the skimmer tube 38 and the outer surface of the cylindrical bladder support chambers 46.

From the space in the closed lower end of the skimmer tube 38, the hydrocarbon can, during the exhaust cycle of the pump, flow upwardly through the lower check valve assembly 66 into the interior of the pump, slowly filling that space defined within the bladder 62. At this time, the hydrostatic head of the hydrocarbon is entirely adequate to cause the ball check 122 to be unseated to allow the hydrocarbon to move upwardly through the lower check valve assembly into this space within the bladder 62. The timing of the exhaust cycle has been set to allow adequate time for substantially the entire space within the bladder 62 to become filled with hydrocarbon.

At the end of the exhaust cycle, the pressure cycle commences, and at this time, the three-way poppet valve 132 is shifted to a position such that pressurized air in the conduit 144 is directed into the pipe 24 and from the pipe 24 into the fluid flow tubes 128 and 130. The fluid flow tubes 128 and 130 introduce the pressurized air into the lower end of the space between the bladder 62 and the cylindrical bladder support chamber 46. This causes the bladder to be collapsed inwardly to the dashed line position shown in FIG. 1. Inward movement of the bladder 62 in this fashion expresses, or forces the discharge of, the hydrocarbon liquid contained in the interior of the bladder. The hydrocarbon liquid, as thus placed under pressure by the collapse or constriction of the bladder 62, forces the ball check 96 of the upper check valve assembly 64 to unseat and this check valve assembly opens. The hydrocarbon liquid can thus be discharged through the discharge pipe 22 which is connected to the short tubing section 101 which projects through the center of the top skimmer tube plate 42.

After the pressure cycle has been maintained for the present duration, the bladder is totally collapsed or constricted, as shown in FIG. 5 of the drawings. At this time, all of the hydrocarbon liquid will have been discharged from the space within the bladder. In the next cycle of the pump, a vacuum is applied to the bladder 62 to cause it to move outwardly from its collapsed position and to resume its original position in which it lies smoothly along, and in registry with, the internal wall of the cylindrical bladder support chamber 46. This is an important characteristic and feature of the present invention. Application of the vacuum assures that the bladder will be distended to its fully open position in a uniform manner. Any tendency of the sides of the collapsed bladder to stick to each other is overcome. The uniform and timely return of the bladder to its position for receiving the hydrocarbon liquid to be pumped assures that the service life of the bladder will be greatly extended, and that discontinuities or stress points which are likely to cause a rupture or failure of the bladder at certain points therealong are minimized. In general, the overall service and effective operating life of the bladder pump is greatly extended.

Although certain preferred embodiments of the invention have been herein described, it will be understood that various changes and innovations of the invention can be effected without departure from the basic operating principles which have been described. For example, the bladder 62 can be constructed as a single cylindrical unit, although this is a less preferred form of the invention. Changes of this type are deemed to be circumscribed by the spirit and scope of the invention, except as the same may be necessarily limited by the appended claims or reasonable equivalents thereof.

What is claimed is:

1. A bladder pump assembly comprising:

an external skimmer tube having a closed bottom, and a closed upper end;

means for admitting liquid to the interior of the skimmer tube from a location near the upper end thereof;

a cylindrical bladder support chamber positioned concentrically within the external skimmer tube, and defining an annular space therewith, said bladder support chamber having a lower end spaced upwardly from the closed bottom of said skimmer tube and having an upper end, said bladder support chamber comprising a pair of semicylindrical members each having a pair of opposed, radially outwardly extending diametric flanges with the flanges on the semicylindrical members in said pair of said semicylindrical members abutting each other and secured together;

a flexible bladder lining the inner wall of at least a major portion of said support chamber and capable of flexing radially inwardly from said inner wall toward the axis of said cylindrical bladder support chamber;

a lower check valve assembly pressed into the lower end of the bladder support chamber and having the lower end of said bladder therearound and trapped between the exterior of said lower check valve assembly and the inner wall of said bladder support chamber, said lower check valve assembly functioning to open to admit liquid into said bladder from said annular space and said space between said support chamber lower end and said skimmer tube lower end when no pressure is applied to the outer side of said cylindrical flexible chamber;

an upper check valve assembly pressed into the upper end of the bladder support chamber and having the upper end of said bladder therearound and trapped between said upper check valve assembly and the inner wall of said bladder support chamber, said upper check valve assembly functioning to open to permit the discharge of liquid therethrough from the interior of said bladder when air under pressure is introduced between said bladder and said bladder support chamber;

a liquid discharge pipe connected to said upper check valve assembly for receiving liquid pumped through said upper check valve assembly from the interior of the bladder; and a remote pneumatic pump cycle control system connected to the bladder support chamber for delivering air under pressure to the space between said bladder and said bladder support chamber, and for evacuating the space between the bladder and the bladder support chamber following the radially inward collapse of the bladder by air under pressure.

2. A bladder pump assembly as defined in claim 1 wherein pump cycle control system comprises:

a source of air under pressure;

a source of vacuum; and a three-way control valve connected to said bladder support chamber for periodically shifting between (a) a pressuring position for delivering air under pressure from said source of air under pressure to the space between said bladder and said bladder support chamber, and (b) an evacuating position for connecting said space between said bladder and said bladder support chamber to said source of vacuum, and (c) an atmsopheric exhaust position in which air from said space between the bladder and said bladder support chamber is vented to the atmosphere.

3. A bladder pump assembly as defined in claim 2 wherein said source of vacuum is a Venturi ejector.

4. A bladder pump assembly comprising:

an external skimmer tube having a closed bottom, and a closed upper end;

means for admitting liquid to the interior of the skimmer tube from a location near the upper end thereof;

a cylindrical bladder support chamber positioned concentrically within the external skimmer tube and defining an annular space therewith, said bladder support chamber having a lower end spaced upwardly from the closed bottom of said skimmer tube and having an upper end;

a flexible bladder lining the inner wall of at least a major portion of said support chamber and capable of flexing radially inwardly from said inner wall toward the axis of said cylindrical bladder support chamber;

a lower check valve assembly pressed into the lower end of the bladder support chamber and having the lower end of said bladder therearound and trapped between the exterior of said lower check valve assembly and the inner wall of said bladder support chamber, said lower check valve assembly functioning to open to admit liquid into said bladder from said annular space and said space between said support chamber lower end and said skimmer tube lower end when no pressure is applied to the outer side of said flexible bladder;

an upper check valve assembly pressed into the upper end of the bladder support chamber and having the upper end of said bladder therearound and trapped between said upper check valve assembly and the inner wall of said bladder support chamber, said upper check valve assembly functioning to open to permit the discharge of liquid therethrough from the interior of said bladder when air under pressure is introduced between said bladder and said bladder support chamber;

a liquid discharge pipe connected to said upper check valve assembly for receiving liquid pumped through said upper check valve assembly from the interior of the bladder; and a remote pneumatic pump cycle control system connected to the bladder support chamber for delivering air under pressure to the space between said bladder and said bladder support chamber, and for evacuating the space between the bladder and the bladder support chamber following the radially inward collapse of the bladder by air under pressure, said pump cycle control system comprising:

a source of air under pressure;

a source of vacuum; and a three-way control valve connected to said bladder support chamber for periodically shifting between (a) a pressuring position for delivering air under pressure from said source of air under pressure to the space between said bladder and said bladder support chamber, and (b) an evacuating position for connecting said space between said bladder and said bladder support chamber to said source of vacuum, and (c) an atmospheric exhaust position in which air from said space between the bladder and said bladder support chamber is vented to the atmosphere, said pump cycle control system further comprising:

a pilot included in said three-way control valve for shifting the control valve in response to air pressure applied to the pilot;

a three-way exhaust cycle valve;

a three-way vacuum cycle valve;

a three-way pressure cycle valve; and conduit means interconnecting said exhaust cycle valve, said vacuum cycle valve and said pressure cycle valve and the pilot of said three-way control valve.

5. A bladder pump assembly as defined in claim 4 wherein said cylindrical bladder support chamber comprises a pair of semicylindrical members each having a pair of opposed radially outwardly extending diametric flanges, with the flange pairs of said semicylindrical members abutting each other and secured together.

6. A bladder pump assembly for pumping deleterious low density liquids from a subterranean location comprising:

an external skimmer tube having a fluid intake slotted upper end portion, and a closed lower end;

a bladder support chamber having an internal wall and a lower end, the bladder support chamber positioned within the external skimmer tube and defining an annular space therebetween, the lower end of the bladder support chamber terminating a distance from the closed lower end of the external skimmer tube;

a flexible bladder supported within the bladder support chamber, the flexible bladder having an upper end, a lower end and a length substantially coextensive in length with the bladder support chamber, the flexible bladder selectively movable between an expanded first position and a collapsed second position, in the expanded first position the flexible bladder being disposed along the internal wall of the bladder support chamber, in the collapsed second position the flexible bladder being flexed radially inwardly from the inner wall of the bladder support chamber in the direction of the axis of the cylindrical bladder support chamber;

a lower check valve supported by the lower end of the flexible bladder and extending into the cavity formed between the lower end of the bladder support chamber and the lower end of the external skimmer tube, the lower check valve having an open mode and a closed mode, in the open mode of the lower check valve the flexible bladder being disposed in the first position so that fluid can be introduced into the flexible bladder, in the closed mode of the lower check valve the flexible bladder being either in transition toward the second collapsed position, or at the second collapsed position;

an upper check valve disposed in the upper end of the flexible bladder, the upper check valve having an open mode and a closed mode, in the open mode of the upper check valve the flexible bladder being disposed in the collapsed second position so that fluid can be removed from the flexible blader, and in the closed mode of the upper check valve the flexible bladder being either in transition toward the first position, or at the first position;

means operably connected to the cylindrical bladder support chamber for selectively delivering fluid under pressure to the bladder support chamber and thereby moving the flexible bladder to the second collapsed position, and for evacuating the bladder support chamber so that the flexible bladder can be moved to the first expanded position, said means for selectively delivering fluid under pressure to the bladder support chamber and for evacuating the same comprising:

at least one flow tube disposed within the annular space formed between the external skimmer tube and the bladder support chamber, one end of the flow tube openly communicating with the interior portion of the bladder support chamber;

pneumatic pump cycle control means operably connected to the flow tube for delivering air under pressure through the flow tube to the bladder support chamber and for evacuating the bladder support chamber; and automatic timing and control means for controlling the time periods during the pumping cycles of the pneumatic pump cycle control system to evacuate the bladder support chamber so that the bladder can be filled with the liquid, and to charge the bladder support chamber when fluid is expelled from the bladder; and wherein each of said lower and upper check valves comprises:

a check valve head having a substantially cylindrical upper portion and a frustoconical lower portion, the frustoconical lower portion positionable within and adjacent the end of the bladder, the check valve head having a central, axially extending bore extending therethrough, the portion of the bore adjacent the frustoconical lower portion being provided with threads, said check valve head having an external annular groove adapted to receive a sealing member;

a check valve seat having external threads adapted to matingly engage the threaded portion of the bore extending through the head, the check valve seat having a seat surface and a fluid passageway extending therethrough, the check valve seat further characterized as having transverse ports for permitting fluid to enter the passageway thereof;

a ball check; and a ball check stop rod extending diametrically across the bore in the cylindrical upper portion for restricting the opening movement of the ball check as the same is removed from the seat surface when the check valve is in an open mode.

7. A bladder pump assembly as defined in claim 6 wherein the bladder support chamber comprises:

a pair of semicylindrical members each having a pair of radially outwardly extending diametric flanges with the flange pairs of the semicylindrical members abutting each other; and means for connecting the abutting flanges of the semicylindrical members; and wherein the bladder comprises:

a pair of opposed flexible members each having a pair of opposed outwardly extending diametric flanges at opposite sides thereof with the flange pairs of the opposed flexible members abutting flanges of the semicylindrical members of the bladder support chamber.

8. A bladder pump assembly comprising:

an external tube having a closed end and fluid inlet means formed in an upper end portion thereof for permitting liquid located adjacent the fluid inlet means to enter the external tube;

a bladder chamber positioned within the external tube so as to define a space therebetween for receiving the liquid entering the external tube, one end of the bladder chamber terminating a distance from the closed lower end of the external tube such that a cavity is formed therebetween;

a flexible bladder supported within the bladder chamber and having an upper end, a lower end and a length substantially coextensive in length with the bladder chamber;

valve means for permitting liquid to be alternately introduced into the bladder and expelled therefrom while preventing reverse flow of liquid from the bladder into the cavity when liquid is expelled, said valve means comprising:

a lower check valve assembly disposed in the lower end of the bladder chamber, the lower check valve assembly having an open mode and a closed mode, and in the open mode of the lower check valve assembly the flexible bladder being disposed in an expanded first position so that fluid can be introduced into the flexible bladder, and in the closed mode of the lower check valve assembly, the flexible bladder being in the second, collapsed position;

an upper check valve assembly disposed in the upper end of the flexible bladder, the upper check valve assembly having an open mode and a closed mode, and in the open mode of said upper check valve assembly, said flexible bladder being disposed in said collapsed second position so that fluid can be removed from the flexible bladder, and in the closed mode of said upper check valve assembly, the flexible bladder being in the expanded first position; and means operably connected to the cylindrical bladder support chamber for selectively delivering fluid under pressure to the bladder support chamber, and thereby moving the flexible bladder to the second, collapsed position, and for evacuating the bladder support chamber so that the flexible bladder can be moved to the expanded first position, said means operably connected to the cylindrical bladder support chamber comprising:

at least one flow tube disposed within the annular space formed between the external skimmer tube and the bladder support chamber and having one end thereof openly communicating with the interior portion of the bladder support chamber for delivering fluid between the chamber and said flexible bladder;

a pneumatic pump cycle control system operably connected to said flow tube for delivering air under pressure through the flow tube to the bladder support chamber, and for evacuating the bladder support chamber; and automatic timing and control means for controlling the time periods during the pumping cycle of the pneumatic pump cycle control system to evacuate the bladder support chamber so that the bladder can be filled with the liquid, and to charge the bladder support chamber when fluid is expelled from the bladder; and a liquid discharge conduit connected to the upper check valve assembly for receiving liquid pumped through the upper check valve assembly from the interior of the bladder and delivering such received liquid to a remote location.

9. A bladder pump assembly comprising:

an external skimmer tube having a closed bottom, and an upper end;

means for admitting liquid to the interior of the skimmer tube from a location near the upper end thereof;

a cylindrical bladder support chamber positioned concentrically within the external skimmer tube, and defining an annular space therewith, said bladder support chamber having a lower end spaced upwardly from the closed bottom of said skimmer tube and having an upper end;

a flexible, two-part bladder positioned within said cylindrical support chamber, said two-part bladder comprising a pair of superimposed sheets of flexible material having opposite side edges secured together to form a fluid tight enclosure between said sheets, said flexible bladder being positioned relatively near to the inner wall of at least a major portion of said support chamber at one time during the operation of said bladder pump as compared to the bladder's position at a different time during the operation of the bladder pump, and capable of flexing radially inwardly from its position relatively near to said inner wall toward the axis of said cylindrical support chamber;

a lower check valve assembly pressed into the lower end of the bladder support chamber and having the lower end of said bladder positioned therearound and sealed therearound so that said lower check valve assembly communicates with the interior of said bladder said lower check valve assembly functioning to open to admit liquid into said bladder from said annular space, and from said space between said support chamber lower end and said skimmer tube lower end when no pressure is applied to the outer side of said flexible chamber;

an upper check valve assembly pressed into the upper end of the bladder support chamber and having the upper end of said bladder extending therearound and sealed therearound, and said upper check valve assembly communicating with the interior of the bladder, said upper check valve assembly functioning to open to permit the discharge of liquid therethrough from the interior of said bladder when air under pressure is introduced between said bladder and said bladder support chamber;

a liquid discharge pipe connected to said upper check valve assembly for receiving liquid pumped through said upper check valve assembly from the interior of the bladder; and a remote pneumatic pump cycle control system connected to the bladder support chamber for delivering air under pressure to the space between said bladder and said bladder support chamber, and for evacuating the space between the bladder and the bladder support chamber following the radially inward collapse of the bladder by air under pressure.

* * * * *